US008733584B2

(12) United States Patent
Auzenne

(10) Patent No.: US 8,733,584 B2
(45) Date of Patent: May 27, 2014

(54) BEVERAGE CONTAINER STOPPER SYSTEMS

(76) Inventor: Gerald Keith Auzenne, Phoenix, AZ (US)

( * ) Notice: Subject to any disclaimer, the term of this patent is extended or adjusted under 35 U.S.C. 154(b) by 1740 days.

(21) Appl. No.: 11/461,385

(22) Filed: Jul. 31, 2006

(65) Prior Publication Data

US 2007/0023442 A1 Feb. 1, 2007

Related U.S. Application Data

(60) Provisional application No. 60/703,903, filed on Aug. 1, 2005, provisional application No. 60/744,313, filed on Apr. 5, 2006.

(51) Int. Cl.
*B65D 43/04* (2006.01)

(52) U.S. Cl.
USPC ..... 220/801; 220/376; 220/254.1; 215/230

(58) Field of Classification Search
USPC ..... 220/801, 376, 713, 719, 789, 254.1, 220/DIG. 19; 215/356, 50, 203, 206, 224, 215/230, 296, 298
See application file for complete search history.

(56) References Cited

U.S. PATENT DOCUMENTS

| | | | | |
|---|---|---|---|---|
| 879,740 | A * | 2/1908 | Cohen | 215/203 |
| 2,427,664 | A * | 9/1947 | Dunbar et al. | 128/867 |
| 3,442,377 | A | 5/1969 | Angelus | |
| 3,659,738 | A * | 5/1972 | Friedmann et al. | 220/287 |
| 3,664,541 | A | 5/1972 | Ruskin | |
| 4,387,826 | A | 6/1983 | Heubl | |
| 5,842,594 | A | 12/1998 | Ibara | |
| 6,016,914 | A | 1/2000 | Gustafson | |
| 6,644,490 | B2 | 11/2003 | Clarke | |
| 6,679,397 | B2 * | 1/2004 | Smith et al. | 220/254.1 |
| 6,886,707 | B2 | 5/2005 | Giraud | |
| 2003/0089714 | A1 | 5/2003 | Dart et al. | |
| 2004/0065662 | A1 | 4/2004 | Coleman | |
| 2004/0094549 | A1 * | 5/2004 | Ryan et al. | 220/254.1 |
| 2004/0118847 | A1 | 6/2004 | Giraud | |
| 2005/0092748 | A1 | 5/2005 | Durdon | |
| 2005/0199631 | A1 | 9/2005 | Alois | |
| 2006/0016823 | A1 * | 1/2006 | Noon | 220/791 |
| 2007/0012709 | A1 * | 1/2007 | Durdon et al. | 220/791 |

* cited by examiner

*Primary Examiner* — Jeffrey Allen
(74) *Attorney, Agent, or Firm* — Stoneman Law Patent Group; Martin L. Stoneman; David A. Spellman

(57) ABSTRACT

A system for preventing beverage spills from disposable cup lids. More particularly this invention comprises a circumferentially ridged stopper adapted to fit within the non-circular sipping aperture of a disposable cup lid. Preferred embodiments of the system comprise indicia, packaging, and methods of use.

20 Claims, 6 Drawing Sheets

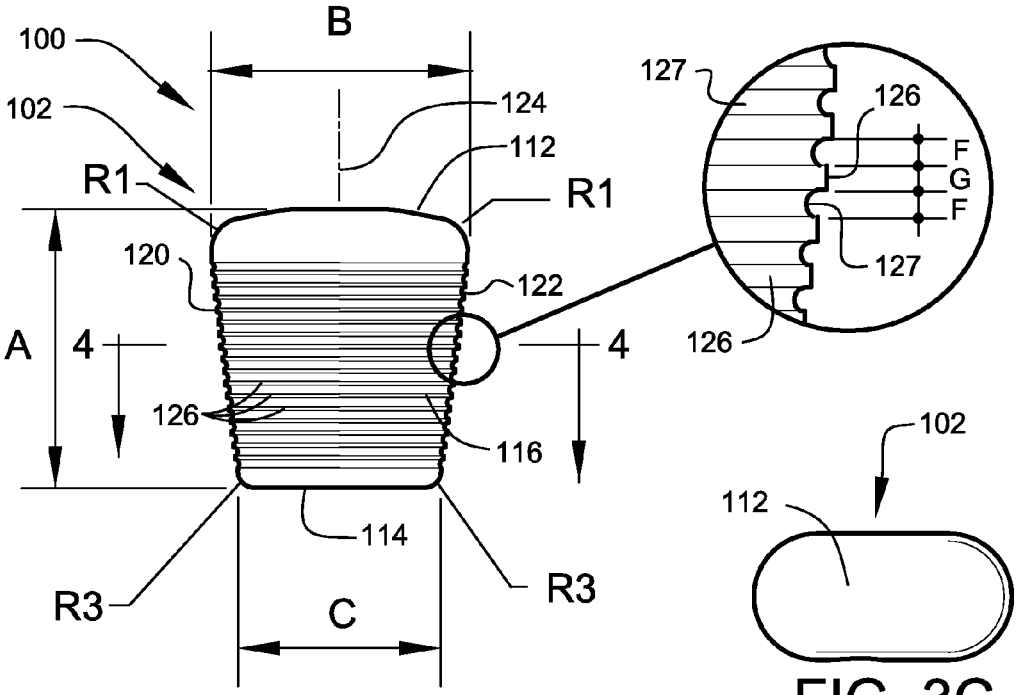
FIG. 3A
FIG. 3C
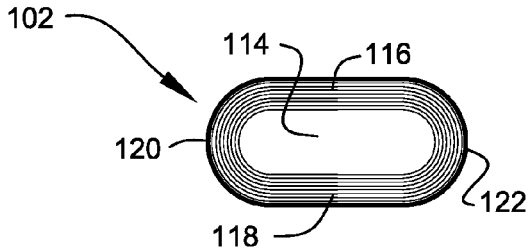
FIG. 3D
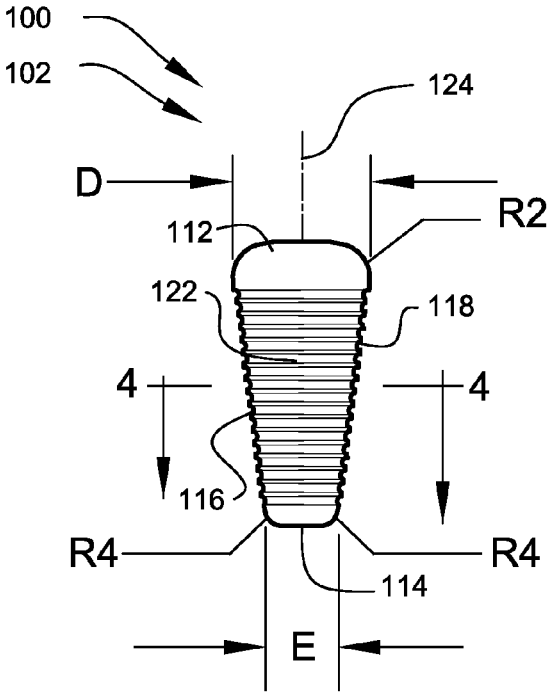
FIG. 3B
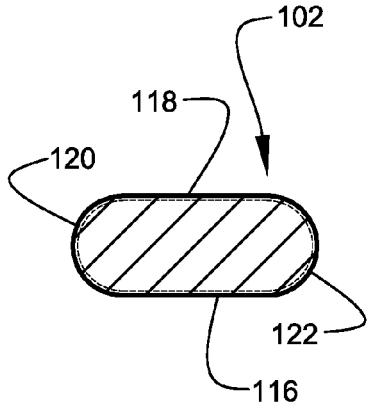
FIG. 4

BEVERAGE CONTAINER STOPPER SYSTEMS

CROSS-REFERENCE TO RELATED APPLICATION

The present application is related to and claims priority from prior provisional application Ser. No. 60/703,903, filed Aug. 1, 2005, entitled "PLASTIC LID HOT BEVERAGE PLUG—A.K.A. —COFFEE STOP", and is related to and claims priority from prior provisional application Ser. No. 60/744,313, filed Apr. 05, 2006, entitled "BEVERAGE CONTAINER STOPPER SYSTEMS" the contents of both of which are incorporated herein by this reference and are not admitted to be prior art with respect to the present invention by the mention in this cross-reference section.

BACKGROUND

This invention relates to providing a system for preventing spilled beverages from disposable cup lids. More particularly this invention relates to providing a system to assist in preventing sporadic liquid spillage of beverages that are contained in disposable paper or Styrofoam cups.

The prevalence of retail sites offering hot beverage products has greatly increased in the recent decade. In many urban centers of the United States, a retail coffee store seemingly occupies the corner of most street intersections, a testament to the frequency with which coffee consumers purchase such products. A majority of these products are served at a temperature hot enough to cause burns or, at a minimum, significant discomfort if spilled on the skin. Hot beverages, such as coffee, are maintained at or near the boiling temperature prior to service. A beverage at a temperature of greater than 80-degrees Centigrade has the potential to scald or otherwise damage the skin if spilled.

Typically, the hot beverage products are served in a"to-go-style" cup, comprising a disposable cup and "drink-through-type" lid. The lid comprises an oval (non-circular) sipping aperture providing access to the beverage. Often, while the cup is at three quarter or greater liquid level, the beverage contained within can leak out of the oval-shaped sipping aperture. This generally occurs while the container is placed in a moving vehicle within a standard cup-holding device such as is found in most modem vehicles. While the vehicle is in motion, bumps in the road, turning, stopping and acceleration cause the liquid to splash or spill out of the cup lid through the oval mouth opening.

Clearly, a need exists for a system adapted to prevent this common over spillage while driving, and as an aid in preventing coffee stains from ruining clothing, seat fabric, flooring, carpeting and plastic within the immediate area of the cup holder of a vehicle.

OBJECTS AND FEATURES OF THE INVENTION

A primary object and feature of the present invention is to provide a system to overcome the above-described problem.

Another primary object and feature of the present invention is to provide a system for temporarily "plugging" the oval sipping aperture of the coffee lid during transport.

It is a further object and feature of the present invention to provide such a system to assist in distinguishing one beverage cup from a plurality of substantially similar beverage cups.

It is another object and feature of the present invention to provide such a system comprising themed indicia.

It is a further object and feature of the present invention to provide such a system comprising custom indicia and a method of delivering such custom embodiments to a consumer.

It is another object and feature of the present invention to provide such a system packaged to promote purchase and use of the system.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system related to stoppering at least one non-circular sipping aperture located within at least one disposable lid of at least one beverage cup comprising: at least one stopper body structured and arranged to stopper the at least one non-circular sipping aperture; wherein such at least one stopper body comprises at least one top portion, at least one bottom portion, and at least one longitudinal axis extending through such at least one top portion and such at least one bottom portion; wherein at least one portion of such at least one stopper body comprises at least two feature sets comprising cross sections, each cross section defined by a rectangular portion with at least one set of its opposing sides capped with rounded ends, each such cross section being oriented substantially perpendicular to such at least one longitudinal axis; wherein each feature set of such at least two feature sets of such cross sections comprises a first such cross section comprising a first perimeter, a second such cross section comprising a second perimeter, a third such cross section comprising a third perimeter, a fourth such cross section comprising a fourth perimeter; wherein such second perimeter is lower in perimeter value than both such first perimeter and such third perimeter, wherein such third perimeter is lower in perimeter value than such first perimeter, wherein such fourth perimeter is lower in perimeter value than such second perimeter and such third perimeter, wherein such first such cross section is positioned above such second such cross section, wherein such second such cross section is positioned above such third such cross section, and wherein such third such cross section is positioned above such fourth such cross section; wherein each feature set of such at least two feature sets further comprises a continuous concave curve joining such first such cross section and such third such cross section. Moreover, it provides such a system wherein such at least one top portion comprises at least one grip adapted to assist user gripping of such at least one stopper body. Additionally, it provides such a system wherein such at least one grip comprises graphic indicia. Also, it provides such a system wherein such at least one grip comprises at least one shape of at least one recognizable symbol. In addition, it provides such a system wherein such continuous concave curve has depth about equal to its width. And, it provides such a system wherein such at least one grip comprises indicia. Further, it provides such a system wherein such at least one stopper body further comprises at least one first set of opposing sides and at least one second set of opposing sides. Even further, it provides such a system wherein: such at least one first set of opposing sides comprises at least one front wall and at least one rear wall; and such at least one second set of opposing sides comprise at least one first curving sidewall and at least one second curving sidewall. Moreover, it provides such a system wherein such at least one stopper body comprises an overall height measured between such at least one top portion and such at least one bottom portion of about one-half of one inch. Additionally, it provides such a system further comprising at least one container comprising at least one hollow interior compartment adapted to removably contain a plurality of such at least one stopper body. Also, it provides such a system wherein such at least one container comprises at least one transparent portion adapted to provide at least one view of such at least one hollow interior compartment from outside such at least one container, even when such at least one container is in a closed position. In addition, it provides such a system wherein such at least one container comprises at least one aperture adapted to assist in the hanging display of such plurality of such at least one stopper bodies. And, it provides such a system further comprising at least one retail display fixture adapted to assist retail display of such plurality of such at least one stopper body. Further, it provides such a system wherein such at least one stopper body is constructed from at least one material substantially matching that of the at least one disposable lid. Even further, it provides such a system wherein such at least one container comprises at least one plurality of stopper bodies, and wherein each stopper body of such at least one plurality of stopper bodies comprises distinguishing indicia uniquely distinguishing each stopper body from each other stopper body. Even further, it provides such a system wherein such at least one stopper body comprises at least one stopper motif and at least one themed image compatible with such at least one stopper motif. Even further, it provides such a system wherein such at least one stopper body comprises graphic indicia selected by at least one customer. Even further, it provides such a system wherein such at least one grip comprises graphic indicia selected by at least one customer. Even further, it provides such a system wherein such at least one grip is in the shape of at least one recognizable symbol. Even further, it provides such a system wherein such at least one grip is in the shape of at least one recognizable symbol selected by at least one customer.

In accordance with a preferred embodiment hereof, this invention provides a method related to distinguishing at least one beverage cup from a plurality of beverage cups, each at least one beverage cup comprising at least one non-circular sipping aperture located within at least one disposable lid, comprising the steps of: providing at least one plurality of stoppers, each stopper of such at least one plurality adapted to removably stopper the at least one non-circular sipping aperture; and applying to each stopper, of such at least one plurality of stoppers, distinguishing indicia adapted to uniquely distinguish each stopper of such at least one plurality of stoppers from each other stopper, wherein such at least one beverage cup stoppered by at least one stopper of such at least one plurality of stoppers is uniquely distinguished from at least one other at least one beverage cup stoppered by at least one other stopper of such at least one plurality of stoppers. Moreover, it provides such a method further comprising the step of grouping such at least one plurality of stoppers in at least one package.

In accordance with another preferred embodiment hereof, this invention provides a method related to providing a plurality of themed stoppers each one adapted to stopper at least one non-circular sipping aperture located within at least one disposable lid of at least one beverage cup comprising the steps of: selecting at least one stopper motif; selecting at least one first themed image compatible with such at least one stopper motif; applying such at least one first themed image to at least one first such themed stopper; providing at least one package adapted to hold at least one such themed stopper; and packaging within such at least one package, such at least one first such themed stopper comprising such at least one first themed image.

Additionally, it provides such a method further comprising the step of packaging within such at least one package, at least two such at least one first such themed stoppers, each one comprising such at least one first themed image. Also, it provides such a method further comprising the step of: selecting at least one second themed image compatible with such at least one stopper motif; applying such at least one second themed image to at least one second such themed stopper; packaging within such at least one package, such at least one first such themed stopper comprising such at least one first themed image and such at least one second such themed stopper comprising such at least one second themed image. In addition, it provides such a method wherein such at least one stopper motif comprises at least one seasonal depiction.

In accordance with another preferred embodiment hereof, this invention provides a method relating to providing at least one custom stopper adapted to stopper at least one sipping aperture located within at least one disposable lid of at least one beverage cup comprising the steps of: offering to sell such at least one custom stopper; providing for acceptance of orders and payment from at least one customer for such at least one custom stopper; providing at least one customer interface adapted to assist user specification of custom indicia to be incorporated within such at least one custom stopper; providing for the manufacture of such at least one custom stopper, wherein such at least one custom stopper comprises such custom indicia; and providing for shipping to the at least one customer such at least one custom stopper. And, it provides such a business methods wherein such step of offering is performed through at least one Internet site operated in conjunction with at least one website server.

In accordance with another preferred embodiment hereof, this invention provides a system related to stoppering at least one non-circular sipping aperture located within at least one disposable lid of at least one beverage cup comprising: at least one stopper body adapted to stopper the at least one non-circular sipping aperture; wherein such at least one stopper body comprises at least one top end portion, at least one bottom end portion, at least one first set of opposing sides, and at least one second set of opposing sides; wherein such at least one first set of opposing sides and such at least one second set of opposing sides are arranged to correspond substantially to the non-circular shape of the at least one non-circular sipping aperture; and at least one of such at least one first set of opposing sides and such at least one second set of opposing sides comprise at least one projecting rib adapted to frictionally engage the non-circular shape of the at least one non-circular sipping aperture.

Further, it provides such a system wherein such at least one projecting rib resides generally along at least one transverse plane oriented substantially perpendicular to at least one longitudinal axis passing through such at least one top end portion and such at least one bottom end portion of such at least one stopper body. Even further, it provides such a system wherein: such at least one first set of opposing sides comprises at least one front wall and at least one rear wall; such at least one second set of opposing sides comprise at least one first curving sidewall and at least second curving sidewall; such at least one projecting rib is arranged circumferentially about such at least one front wall, such at least one rear wall, such at least one first curving sidewall and such at least second curving sidewall.

Moreover, it provides such a system wherein: such at least one top end portion comprises a length of about one-half of one inch and a width of about one-quarter of one inch; and such at least one bottom end portion comprises a length of about three-eighths of one inch and a width of about one-eighth of one inch. Additionally, it provides such a system wherein such at least one stopper body comprises an overall height measured between such at least one top end portion and such at least one bottom end portion of about one-half of one inch. Also, it provides such a system wherein: such at least one stopper body comprises a plurality of such at least one projecting ribs; each such at least one projecting rib comprises a thickness of about one-sixty-fourth of one inch; and the distance between each one of such plurality of such at least one projecting ribs is about one thirty-second of one inch. In addition, it provides such a system further comprising: at least one valley structured an arranged to engage at least one inner peripheral edge of the at least one non-circular sipping aperture; wherein such at least one valley is situated adjacent such at least one projecting rib; such at least one valley extends circumferentially about such at least one stopper body; such at least one valley comprises a width of about one-sixty-fourth of one inch; and such at least one valley comprises at least one substantially continuous concave curve, having a depth about equal to its width.

And, it provides such a system wherein such at least one top end portion comprises at least one grip adapted to assist user gripping of such at least one stopper body. Further, it provides such a system wherein such at least one grip comprises graphic indicia. Even further, it provides such a system further comprising at least one container comprising at least one hollow interior compartment adapted to removably contain a plurality of such at least one stopper bodies. Even further, it provides such a system wherein such at least one container comprises at least one transparent portion adapted to provide at least one view of such at least one hollow interior compartment from outside such at least one container, even when such at least one container is in a closed position. Even further, it provides such a system wherein such at least one container comprises at least one aperture feature adapted to assist in hanging retail display of such plurality of such at least one stopper bodies. Even further, it provides such a system further comprising at least one retail display fixture adapted to assist retail display of such plurality of such at least one stopper bodies, and wherein said at least one stopper body is constructed from at least one material substantially matching that of the at least one disposable lid.

In accordance with another preferred embodiment hereof, this invention provides a method relating to providing at least one fluid stopper adapted to stopper at least one non-circular sipping aperture located within at least one disposable cup lid of least one cup adapted to contain at least one beverage product, such method comprising the steps of: offering such at least one fluid stopper to at least one vendor; taking at least one order to supply such at least one fluid stopper to the at least one vendor; producing such at least one fluid stopper substantially matching vendor branding requirements of the at least one vendor; taking at least one payment for such at least one fluid stopper; and delivering such at least one fluid stopper comprising at least one vendor brand to the at least one vendor.

BRIEF DESCRIPTION OF THE DRAWINGS

FIG. 3A shows a front elevational view of the lid stopper according to the preferred embodiment of FIG. 1.

FIG. 3B shows a side elevational view of the lid stopper according to the preferred embodiment of FIG. 1.

FIG. 3C shows a top elevational view of the lid stopper according to the preferred embodiment of FIG. 1.

FIG. 3D shows a bottom elevational view of the lid stopper according to the preferred embodiment of FIG. 1.

FIG. 4 shows a sectional view through the section 4-4 of FIG. 3A and 3B.

DETAILED DESCRIPTION OF THE BEST MODES AND PREFERRED EMBODIMENTS OF THE INVENTION

Figure 1:
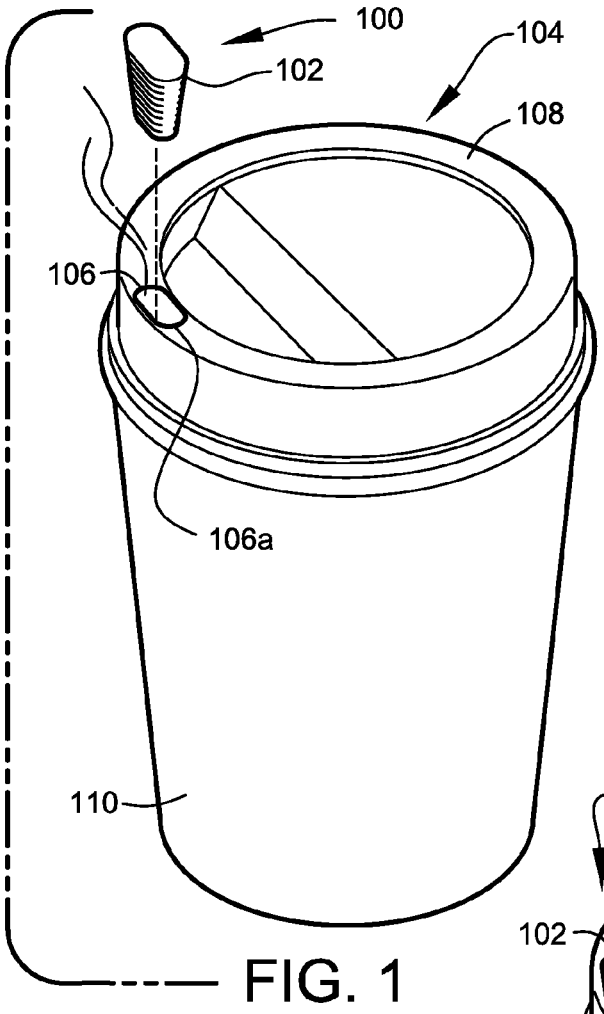
FIG. 1 shows a perspective view illustrating a lid stopper of a beverage container stopper system, adjacent a beverage container comprising an oval (non-circular) sipping aperture, according to a preferred embodiment of the present invention.
Figure 2:
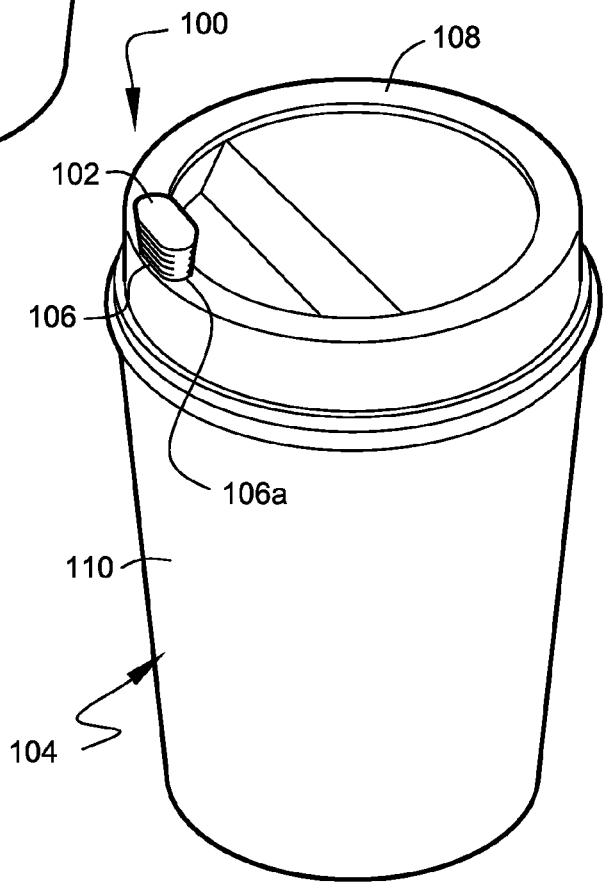
FIG. 2 shows a perspective view of the lid stopper plugging the sipping aperture of the beverage container according to the preferred embodiment of FIG. 1.

FIG. 1 shows a perspective view illustrating lid stopper 102 of beverage container stopper system 100, adjacent beverage container 104 comprising an oval (non-circular) sipping aperture 106, according to a preferred embodiment of the present invention. FIG. 2 shows a perspective view of lid stopper 102 plugging sipping aperture 106 of beverage container 104.

Preferably, beverage container 104 comprises disposable lid 108 and disposable cup 110, as shown. Preferably, disposable lid 108 comprises a "drink-through-type lid" allowing the user to drink the beverage with the lid covering the cup, as shown. Preferably, sipping aperture 106 of disposable lid 108 comprises a size and non-circular shape found in many commercially available lid brands. Upon reading the teachings of this specification, those of ordinary skill in the art will now understand that, under appropriate circumstances, such as user preference, advances in technology, intended use, etc., other cup lids, such as cup lids having apertures of other shapes and/or circumferences, etc., may suffice.

Preferably, lid stopper 102 (at least embodying herein at least one stopper body adapted to stopper the at least one non-circular sipping aperture) is adapted to firmly (and removably) engage sipping aperture 106, as shown. While engaged within sipping aperture 106, lid stopper 102 forms a liquid-tight seal to assist in maintaining the beverage within beverage container 104.

Sipping apertures 106 of many lid brands are substantially similar in shape, and fall within a narrow range of similar aperture sizes. Typically, the shape of sipping aperture 106 comprises two substantially parallel straight sides adjoining a pair of semi-circular ends, as shown. Preferably, the cross-sectional shape of lid stopper 102 is adapted to closely match that of sipping aperture 106, as shown (at least embodying herein wherein such at least one first set of opposing sides and such at least one second set of opposing sides are arranged to correspond substantially to the non-circular shape of the at least one non-circular sipping aperture).

FIG. 3A shows a front elevational view of lid stopper 102 with FIG. 3B showing a side elevational view of lid stopper 102, according to the preferred embodiment of FIG. 1. FIG. 3C shows a top elevational view of lid stopper 102 according to the preferred embodiment of FIG. 1. FIG. 3D shows a bottom elevational view of lid stopper 102 according to the preferred embodiment of FIG. 1. FIG. 3D shows the preferred cross section of a portion of lid stopper 102, namely, a rectangular portion with at least one set of its opposing sides capped with rounded ends, as shown. FIG. 3D and FIG. 3A illustrate the preferred arrangement of the cross sections of lid stopper 102. The cross sections are preferably oriented substantially perpendicular to at least one longitudinal axis (such as longitudinal axis 124) of lid stopper 102, as shown in FIG. 3A. The cross sections are preferably arranged with the following features (or feature sets): preferably, there are at least two feature sets of cross sections having different perimeter values. The cross sections of the feature sets are preferably further arranged as follows: a first cross section comprises a first perimeter, a second cross section comprises a second perimeter, a third cross section comprises a third perimeter, a fourth cross section comprises a fourth perimeter (see, e.g., closeup of FIG. 3A and FIG. 3D). Preferably. the second perimeter cross section is lower in perimeter value than both the first perimeter cross section and the third perimeter cross section; the third perimeter cross section is lower in perimeter value than the first perimeter cross section; and the fourth perimeter cross section is lower in perimeter value than the second perimeter cross section and the third perimeter cross section, as shown in FIG. 3A. With respect to the further arrangement of the cross sections, the first cross section is positioned above the second cross section, the second such cross section is positioned above the third cross section, and the third such cross section is positioned above the fourth cross section. Additionally, as shown in FIG. 3A (closeup) a continuous concave curve joins the first cross section and the third cross section.

Preferably, lid stopper 102 comprises a generally wedge-shaped device having a top portion 112, bottom portion 114, front wall 116 (with an opposing rear wall 118), a first curving sidewall 120 and a second curving sidewall 122, as shown. Preferably, the height "A" of lid stopper 102 (as measured between top portion 112 and bottom portion 114) comprises a distance of about one-half of one inch. Preferably, top portion 112 (at least embodying herein wherein such at least one stopper body comprises at least one top end portion) comprises a width "B" of about one-half of one inch and a thickness "D" of about one-quarter of one inch, as shown. Preferably, bottom portion 114 comprises a width "C" of about three-eighths of one inch and a thickness "E" of about one-eighth of one inch, as shown. Preferably, upper edge transitions R1 and R2 of top portion 112 both comprise a radius of about one-sixteenth of one inch, as shown. Preferably, lower edge transitions R3 and R4 of bottom portion 114 both comprise a radius of about one-thirty-second of one inch, as shown.

Preferably, essentially any cross sectional plane bisecting lid stopper 102 (forming a ninety-degree angle with respect to longitudinal axis 124) comprises the distinct non-circular shape of sipping aperture 106, as best illustrated by the sectional view of FIG. 4. Preferably, front wall 116 and rear wall 118 are generally planar and preferably taper toward a virtual line of intersection located substantially below the peripheral boundary of lid stopper 102, as shown.

Preferably, first curving sidewall 120 and second curving sidewall 122 comprise semi-circular peripheral shapes closely corresponding to those of sipping aperture 106, as shown. Preferably, the semi-circular diameters of first curving sidewall 120 and second curving sidewall 122 correspond to the distance separating front wall 116 from rear wall 118, as measured at the above-described bisecting planes. Thus, the wedge-shape of lid stopper 102 effectively accommodates a range of sipping aperture sizes. More specifically, lid stopper 102 assists a user in plugging sipping aperture 106 by passing downwardly through sipping aperture 106 until the outer periphery of lid stopper 102 generally matches the inner peripheral edge 106*a* of sipping aperture 106 in size/shape, as best illustrated in FIG. 2.

Preferably, lid stopper 102 comprises at least one, preferably a plurality of circumferential surface ribs 126, as shown. Preferably, surface ribs 126 extend circumferentially about lid stopper 102, as shown. Most preferably, surface ribs 126 are formed by an alternating arrangement of parallel peaks and valleys extending circumferentially around front wall 116, rear wall 118, first curving sidewall 120, and second curving sidewall 122, as shown.

Preferably, surface ribs 126 function as frictional elements to facilitate a locking or firm placement of lid stopper 102 within the non-circular shape of sipping aperture 106 (at least embodying herein wherein such at least one projecting rib is arranged circumferentially about such at least one front wall, such at least one rear wall, such at least one first curving sidewall, and such at least second curving sidewall; and, at least one of such at least one first set of opposing sides and such at least one second set of opposing sides comprise at least one projecting rib adapted to frictionally engage the non-circular shape of the at least one non-circular sipping aperture).

Preferably, each surface rib 126 lies generally along a transverse plane oriented substantially perpendicular to longitudinal axis 124, as shown. Preferably, the surface ribs 126 are about evenly spaced comprising a center-to-center distance of about one-thirty-second of one inch. Preferably, each surface rib 126 comprises a thickness "F" of about one-sixty-fourth of one inch, as shown. Preferably, each valley 127 comprises a width "G" of about one-sixty-fourth of one inch, as shown. Preferably, the shape of each valley 127 forms a concave curve, having a depth about equal to its width, as shown. Preferably, the outer face of each surface rib 126 is substantially flat, as shown. Preferably, the circumferential shoulders (edges) of each surface rib 126 is generally square, comprising little if any radius as it transitions to the adjacent valley 127, as shown. Upon reading the teachings of this specification, those of ordinary skill in the art will now understand that, under appropriate circumstances, considering such issues as intended use, lid thicknesses, lid materials, etc., other shape arrangements, such as, for example, providing smoothly transitioning ridges and valleys, ridges having a directional bias, asymmetrical ridge arrangements to accommodate specific cup brands, etc., may suffice.

Preferably, lid stopper 102 of FIG. 3A comprises about 17 surface ribs 126 adjoining about 18 valleys 127, as shown. This preferred lid stopper embodiment accommodates a wide range of popular disposable lids 108 currently distributed commercially in the United States and around the world. Upon reading the teachings of this specification, those of ordinary skill in the art will now understand that, under appropriate circumstances, considering such issues as changes in disposable lids, sipping-aperture standards, etc., other arrangements, such as, for example, larger ridges, wider valleys, few were ridges and valleys, longer stoppers having a greater quantity of ridges and valleys, and greater angle transitions, etc., may suffice.

Preferably, lid stopper 102 is held within sipping aperture 106 by friction generated between the two parts. More specifically, lid stopper 102 preferably engages sipping aperture 106 by locking the inner peripheral edge 106*a* of sipping aperture 106 within a single valley 127. In addition, sipping aperture 106 is sealed against liquid flow by the two adjacent surface ribs 126 bounding valley 127, as shown. The preferred wedge shape of lid stopper 102 along with the specific configuration of surface ribs 126 and valleys 127 assures that sipping aperture 106 comes to rest within an appropriately sized valley 127. This preferred feature is further facilitated by constructing lid stopper 102 from materials having specific physical properties.

Preferably, the lid stopper 102 comprises a substantially rigid material having a sufficient hardness to achieve a slight deforming of the inner peripheral edge 106*a* of sipping aperture 106, while maintaining sufficient firmness to maintain the above-described liquid seal during use. Through experimentation, the applicant has determined that friction between the two parts is managed best when both the stopper and lid are constructed of materials having substantially the same physical characteristics. Most preferably, lid stopper 102 is constructed from the same material as disposable lid 108. This preferred matching of material characteristics allows lid stopper 102 to slightly deform the inner peripheral edge 106*a* of sipping aperture 106 as it passes over surface ribs 126 having sizes slightly larger than sipping aperture 106 but restricts the passage of sipping aperture 106 as it passes over surface ribs 126 having sizes moderately larger than sipping aperture 106. Thus, a moderate application of pressure by the user during installation of lid stopper 102 usually results in an effective seal of sipping aperture 106.

Preferably, lid stopper 102 comprises a food-grade Polystyrene (PS), preferably comprising a Rockwell M Hardness of about 80 (surface hardness RM80). Although it is preferred that a single material be used in the fabrication of lid stopper 102 (to reduce production costs), those skilled in the art, upon reading the teachings of this specification, will appreciate that, under appropriate circumstances, two or more materials, copolymers, or mixtures may suffice.

Preferably, lid stopper 102 is produced by conventional plastic molding manufacturing techniques. Upon reading the teachings of this specification, those of ordinary skill in the art will now understand that, under appropriate circumstances, considering such issues as intended use, cost, etc., other material arrangements, such as, for example, closed-cell foams, synthetic elastomers, natural rubbers, silicones, polyethylenes, polypropylenes, metal compositions, treated cellulous-based materials, compressed fibers of mixed content, biodegradable polymers, alternate durometers or shore hardness ratings, etc., may suffice.

Figure 5:
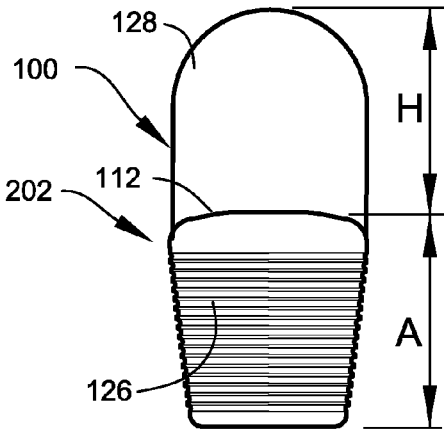
FIG. 5 shows a front elevational view of an alternate lid stopper comprising a finger grip according to the preferred embodiment of FIG. 1.
Figure 6:
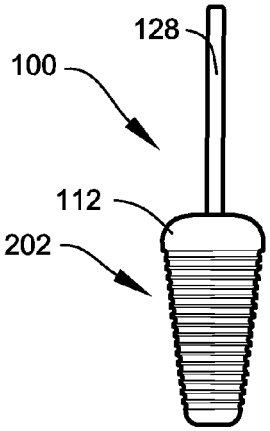
FIG. 6 shows a side elevational view of the alternate lid stopper according to the preferred embodiment of FIG. 5.

FIG. 5 shows a front elevational view of alternate lid stopper 202 comprising finger grip 128 according to the preferred embodiment of FIG. 1. FIG. 6 shows a side elevational view of alternate lid stopper 202 according to the preferred embodiment of FIG. 5. Preferably, alternate lid stopper 202 comprises structures and arrangements substantially similar to those of lid stopper 102, as described above. In addition, top portion 112 of alternate lid stopper 202 comprises a projecting member (finger grip 128) adapted to assist the user in gripping alternate lid stopper 202 (at least embodying herein wherein such one top end portion comprises at least one grip adapted to assist user gripping of such at least one stopper body). Preferably, finger grip 128 is firmly coupled to top portion 112 with attachment by integral molding being most preferred. Upon reading the teachings of this specification, those of ordinary skill in the art will now understand that, under appropriate circumstances, considering such issues as intended use, cost of molding, etc., other grip-to-body attachment arrangements, such as, bonding, snap-fit engagement, threading, pining, etc., may suffice.

In the preferred embodiment of FIG. 5 and FIG. 6, finger grip 128 comprises a simple planar structure having a preferred height "H" about equaling the height "A" of lid stopper 102 (about one-half of one inch), as shown. In alternate preferred embodiments, finger grip 128 is modified to provide enhanced functionality, as described below.

Figure 7:
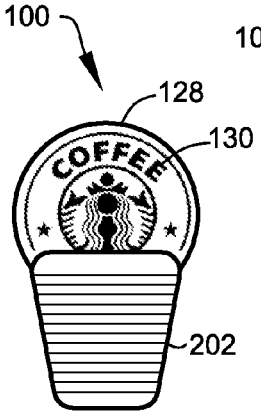
FIG. 7 shows a front elevational view depiction of the alternate lid stopper of FIG. 5 comprising brand indicia according to a preferred embodiment of the present invention.

FIG. 7 shows a front elevational view of the alternate lid stopper 202 of FIG. 5 comprising brand indicia 130 according to a preferred embodiment of the present invention (at least embodying herein wherein such at least one grip comprises graphic indicia). Preferably, finger grip 128 is adaptable to comprise a range of functional and decorative features, as shown. In the preferred embodiment of FIG. 7 brand indicia 130 comprises a company logo or similar associative marking, as shown. In the example of FIG. 7, brand indicium 130 comprises the company logo of a retail coffee vendor. Preferably, brand indicia 130 is surface imprinted or molded within finger grip 128, as shown.

Figure 21:
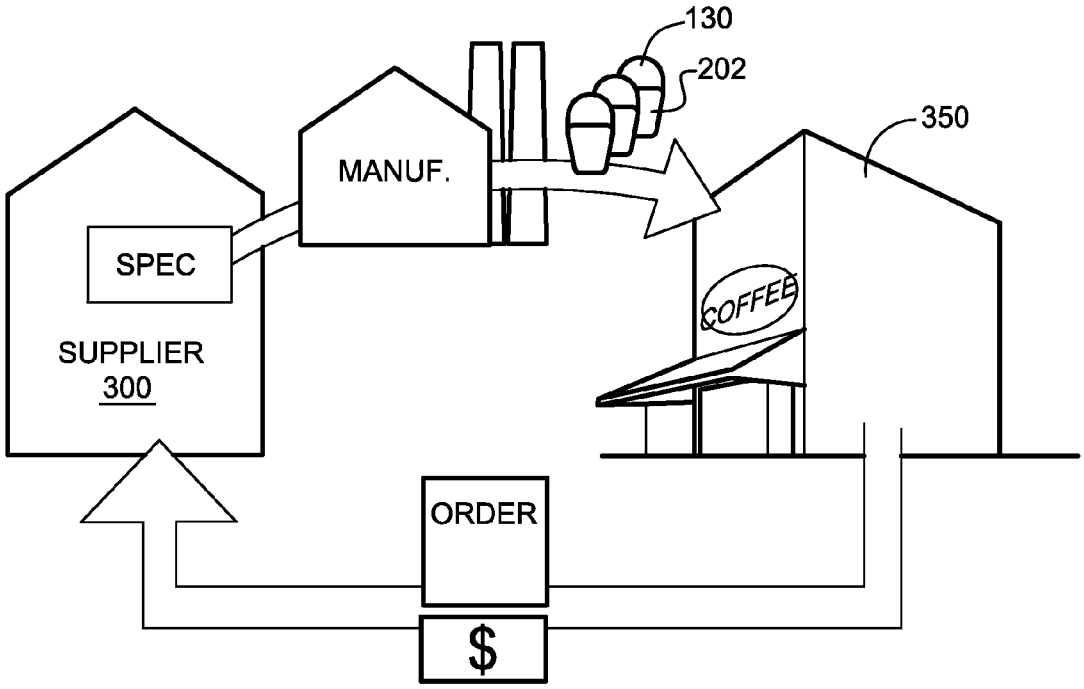
FIG. 21 shows a diagram illustrating a preferred apparatus method according to the present invention.

Preferably, brand indicia 130 is used to support unique business methods (using embodiments of the present invention) adapted to promote product use, as further described in FIG. 21. Referring to the diagram of FIG. 21, Supplier 300 preferably offers alternate lid stopper 202 to at least one Vendor 350 that uses disposable lid 108 in commerce. Vendor 350 preferably comprises a coffee and beverage retailer or related business. Preferably, Supplier 300 takes at least one order from Vendor 350 to supply alternate lid stoppers 202, as shown. Preferably, supplier 300 works with Vendor 350 to define the design requirements and appropriate brand indicia 130 to be applied to finger grip 128. Next, supplier 300 arranges to produce a quantity of alternate lid stoppers 202, substantially matching the design requirements of Vendor 350. Preferably, supplier 300 takes payment from Vendor 350 and delivers alternate lid stoppers 202 comprising the appropriate brand indicia 130 to Vendor 350, as shown. Vendor 350 may preferably provide the branded stoppers without charge as a marketing incentive to increase sales of the Vendor's beverage products. Alternately, Vendor 350 may preferably sell the branded stoppers as part of the vendor's product line. Upon reading the teachings of this specification, those of ordinary skill in the art will now understand that, under appropriate circumstances, considering such issues as regional market structures, prevailing corporate business models, etc., other novel methods and arrangements, such as, for example, licensing the present invention to a retail outlet for sales to the consumer within their various franchises, licensing to a retail outlet to permit embodiments of the invention to be offered for free to their customer base within their various franchises, licensing manufacturing and distribution rights to large paper suppliers (producing disposable cup/lid products), etc.

Figure 8:
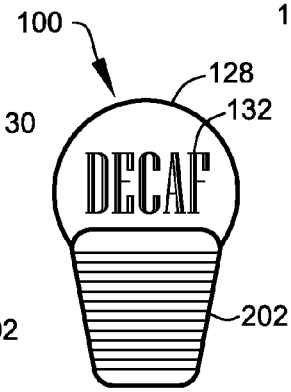
FIG. 8 shows a front elevational view depiction of the alternate lid stopper of FIG. 5 comprising informational indicia according to a preferred embodiment of the present invention.

FIG. 8 shows a front elevational view of alternate lid stopper 202 of FIG. 5 comprising informational indicia 132, according to a preferred embodiment of the present invention (at least embodying herein wherein such at least one grip comprises graphic indicia). Preferably, the embodiment of FIG. 8 is used to convey useful information to the user. In the example of FIG. 8, informational indicium 132 notes the decaffeinated state of the beverage within beverage container 104. Preferably, informational indicium 132 allows a server to quickly and efficiently mark the contents of beverage container 104. Preferably, the content of informational indicia 132 is selected as appropriate to the offering of the Vendor/Server and may preferably include a diverse range of markings including cream, cream-and-sugar, Latte, Espresso, etc.

Figure 9:
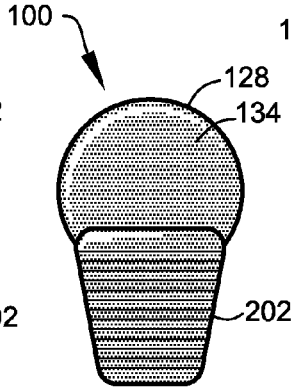
FIG. 9 shows a front elevational view depiction of the alternate lid stopper of FIG. 5 comprising color indicia according to a preferred embodiment of the present invention.

FIG. 9 shows a front elevational view depiction of alternate lid stopper 202 comprising color indicia 134 according to a preferred embodiment of the present invention (at least embodying herein wherein such at least one grip comprises graphic indicia). Preferably, alternate lid stopper 202 of FIG. 9 comprises a display of color (red, yellow, blue, black, etc.). Such color may be applied to alternate lid stopper 202 by coating, mixing or blending the material forming alternate lid stopper 202 with a pigment and/or dye, or by other known methods. Preferably, alternate lid stopper 202 is usable to differentiate one beverage container 104 from another, as further described in FIG. 20.

Figure 10:
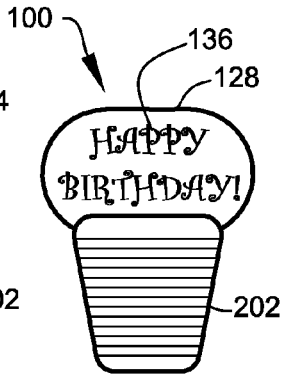
FIG. 10 shows a front elevational view depiction of the alternate lid stopper of FIG. 5 comprising event indicia according to a preferred embodiment of the present invention.

FIG. 10 shows a front elevational view depiction of alternate lid stopper 202 comprising event indicia 136 according to a preferred embodiment of the present invention (at least embodying herein wherein such at least one grip comprises graphic indicia). Preferably, event indicia 136 associates alternate lid stopper 202 with one or more events, as shown. Representative examples of event indicia 136 preferably include indicia related to anniversaries, weddings, showers, sporting events, graduations, retirements, birthdays, etc., as shown.

Figure 11:
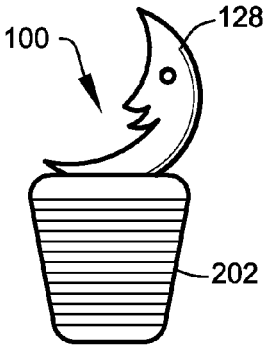
FIG. 11 shows a front elevational view depiction of the alternate lid stopper of FIG. 5 comprising example decorative indicia according to a preferred embodiment of the present invention.
Figure 12:
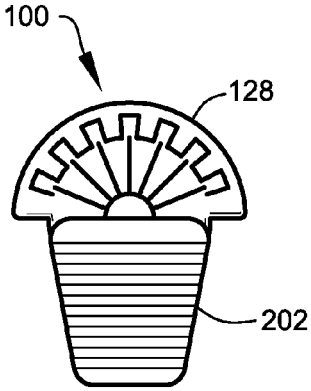
FIG. 12 shows another front elevational view depiction of the alternate lid stopper of FIG. 5 comprising example decorative indicia according to a preferred embodiment of the present invention.
Figure 13:
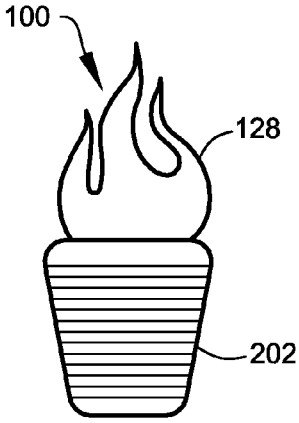
FIG. 13 shows an additional front elevational view depiction of the alternate lid stopper of FIG. 5 comprising example decorative indicia according to a preferred embodiment of the present invention.

FIG. 11 through FIG. 13 show front elevational views of alternate lid stopper 202, comprising examples of decorative indicia 138, according to a preferred embodiment of the present invention. Preferred embodiments of finger grip 128 are adaptable to comprise a variety of decorative shapes, as shown. This preferred feature is suitable as an aid to product marketing and may have additional utility as a distinct identifier for beverage container 104. Preferably, FIG. 11 through FIG. 13 comprises three example decorative indicia 138 including a moon, sunset, and a depiction of flames respectively (at least embodying herein wherein such at least one grip comprises graphic indicia and at least embodying herein wherein said at least one grip comprises at least one shape of at least one recognizable symbol and at least embodying herein wherein said at least one grip is in the shape of at least one recognizable symbol). Decorative indicia 138 preferably comprise imprinting, applied features (such as adhesive appliques), dimensional molding, or various combinations of each, as shown.

Figure 14:
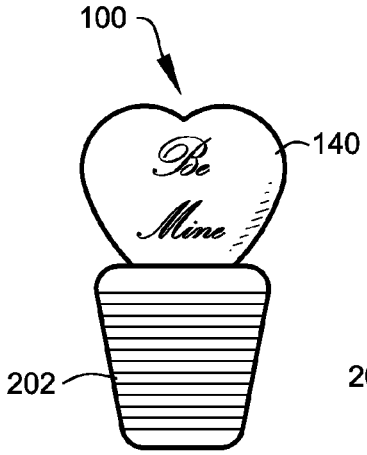
FIG. 14 shows a front elevational view depiction of the alternate lid stopper of FIG. 5 comprising seasonal indicia according to a preferred embodiment of the present invention.
Figure 15:
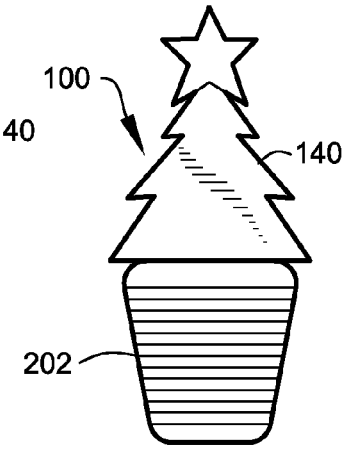
FIG. 15 shows another front elevational view depiction of the alternate lid stopper of FIG. 5 comprising seasonal indicia according to a preferred embodiment of the present invention.

FIG. 14 and FIG. 15 show front elevational views of alternate lid stoppers 202 comprising seasonal indicia 140 according to a preferred embodiment of the present invention. Seasonal indicia 140 preferably comprises seasonal and holiday indicia, such as, for example, Valentines Day, Christmas, etc., as shown. This preferred feature is suitable as an aid to product marketing and is preferably developed into packaged groupings of "themed" stoppers, as described in FIG. 19A.

Figure 16:
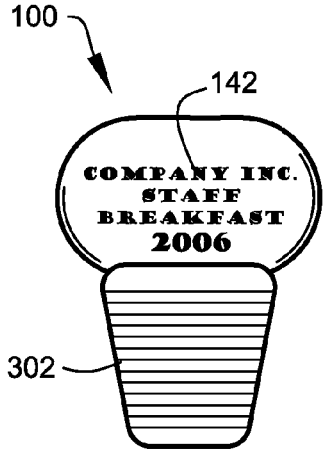
FIG. 16 shows a front elevational view depiction of the alternate lid stopper of FIG. 5 comprising custom indicia according to a preferred embodiment of the present invention.
Figure 22:
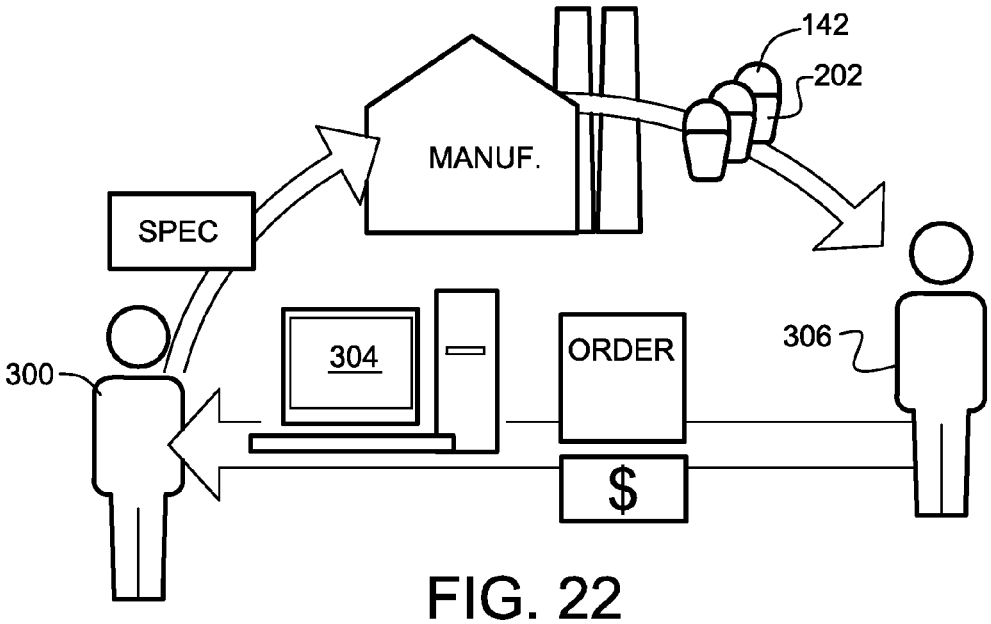
FIG. 22 shows a diagram illustrating another preferred apparatus method according to the present invention.

FIG. 16 shows a front elevational view of custom lid stopper 302 comprising custom indicia 142 according to a preferred embodiment of the present invention. Custom lid stoppers 302 are preferably used to enable a unique business method (utilizing embodiments of the present invention) wherein lid stoppers are user customized and offered for sale, as depicted in FIG. 22. Custom stoppers are preferably sold through "brick-and-mortar" retail suppliers or, most preferably, by means of an internet website 304. Preferably, supplier 300 establishes a website offering custom lid stoppers 302 for sale, as shown in FIG. 22. Preferably, website 304 provides for acceptance of orders and payment from customer 306 for one or more custom lid stoppers 302, as shown.

Preferably, website 304 provides at least one user interface adapted to assist customer 306 in choosing and specifying custom indicia 142 to be incorporated within custom lid stoppers 302. The interface may include choices for quantity, text content, font, colors, graphics, shipping address, payment method, etc. Preferably, supplier 300 uses the specifications provided by customer 306 to manufacture a limited run of such custom lid stoppers 302. Preferably, supplier 300 then provides for shipping the run of custom lid stoppers 302 to customer 306, as shown.

Figure 17:
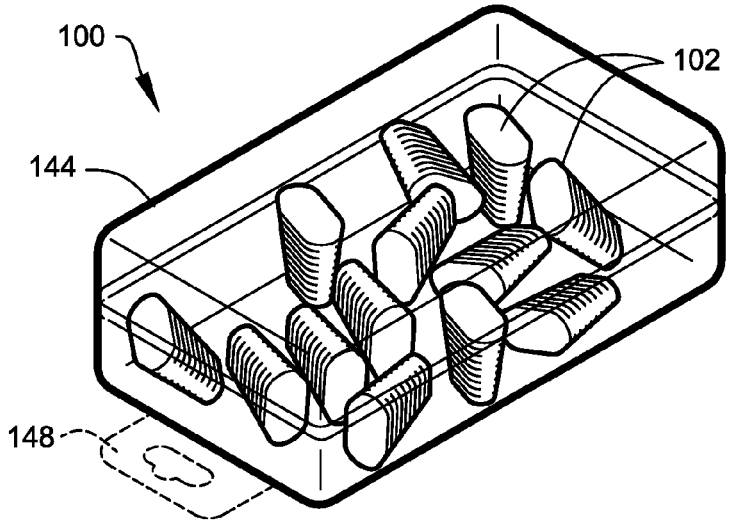
FIG. 17 shows a perspective view of a plurality of lid stoppers, grouped within a container, according to a preferred embodiment of the present invention.

FIG. 17 shows a perspective view of a plurality of lid stoppers 102, grouped within container 144, according to a preferred embodiment of the present invention. For the convenience of the user, pluralities of lid stoppers 102 are preferably grouped within a single container package, as shown. Preferably, container 144 is adaptable to comprise a variety of easily gripped, ergonomic configurations having (in top view and side views) geometries that include square, rectangular, circular, hexagonal, triangular, ovoid, etc. Preferably, container 144 is, in the depicted closed position, essentially rectangular, comprising six adjoining surfaces, preferably with smoothly rounded adjoining edges and corners, as shown. Preferably, container 144 is sized to easily fit within the pocket of the user.

Preferably, container 144 is formed in two sections, with at least one of the sections operable as a movable lid to provide access to the interior of container 144. Most preferably, container 144 is adapted to slide apart to provide access to the plurality of lid stoppers 102 contained therein.

Container 144 (at least embodying herein at least one container comprising at least one hollow interior compartment adapted to removably contain a plurality of said at least one stopper bodies) is preferably constructed from a generally rigid and non-deforming material. To address such issues as cost and ease of manufacturing, it is preferred that container 144 be constructed from a transparent, rigid and moldable thermoplastic, preferably general-purpose polystyrene (such as "Styron 668" as manufactured by Dow Plastics, USA). Within the teachings of this specification, the term "transparent" may also comprise the term "translucent", such that at least one portion of the container material is sufficiently light-permeable to allow a user to determine if an object has been placed within the interior of container 144 (at least embodying herein wherein such at least one container comprises at least one transparent portion adapted to provide at least one view of such at least one hollow interior compartment from outside such at least one container, even when such at least one rigid holder is in a closed position). A preferred color may be provided to the transparent portions of container 144 by coating, mixing or blending the material forming the transparent portion with a pigment and/or dye, or by other well-known methods. Although it is preferred that a single plastic resin be used in the fabrication of container 144 (to reduce production costs), those skilled in the art, upon reading the teachings of this specification, will appreciate that, under appropriate circumstances, two or more materials, copolymers, or mixtures may suffice. Upon reading the teachings of this specification, those of ordinary skill in the art will now understand that, under appropriate circumstances, considering such issues as intended use, etc., other container arrangements, such as, for example, selection of alternate materials, such as, metals, cardboard, paper, etc., non-rigid containers including plastic bags, etc., individual "single stopper" packages, etc., may suffice.

Figure 18:
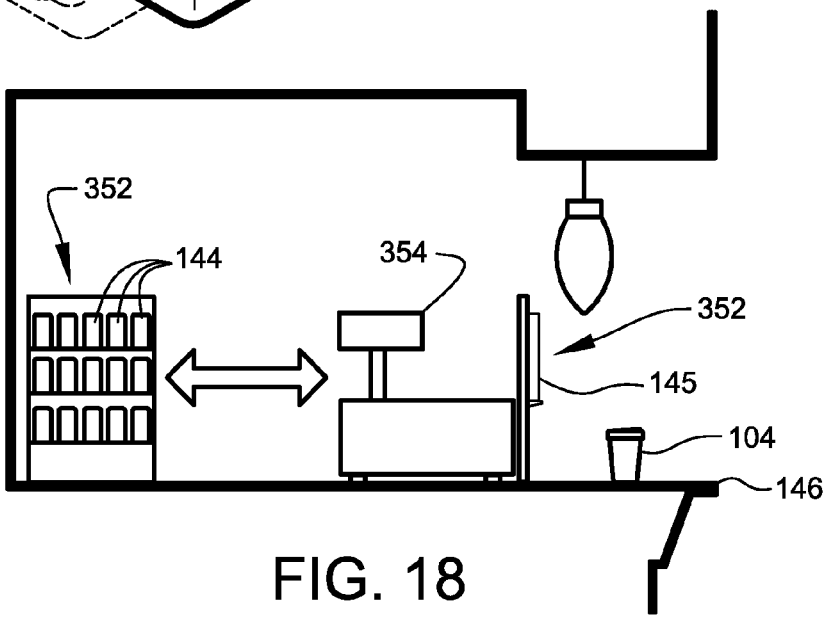
FIG. 18 shows a diagrammatic view illustrating retail packaging adapted to assist in the sale of the beverage container stopper systems.

FIG. 18 shows a diagrammatic view illustrating retail packaging 352 of beverage container stopper system 100 adapted to assist in the sale of the beverage container stopper embodiments (at least embodying herein at least one container comprises at least one feature adapted to assist in retail display of such a plurality of at least one stopper bodies, and at least embodying herein at least one retail display fixture adapted to assist retail display of such plurality of at least one stopper bodies). Preferably, beverage container stopper system 100 comprises packaging adapted to assist in consumer purchase. Preferably, retail packaging 352 is adapted to display purchasable embodiments in the high-traffic areas of the retail beverage site, most preferably adjacent sales register counter 354 (cash wrap), as shown. Preferably, retail packaging 352 comprises one or more display fixtures adapted to display beverage container stopper system 100 and promote "impulse" purchases. Retail packaging 352 is preferably adapted to use minimal counter space by comprising a generally vertical form, as shown. In addition, container 144 preferably comprises display features, such as a removable peg display feature 148, having a peg-receiving aperture, to assist in a hanging product-placement, as shown (at least embodying herein wherein said at least one container comprises at least one aperture adapted to assist in the hanging display of said plurality of said at least one stopper bodies).

Alternately, retail packaging 352 comprises a stopper dispensing device 145, preferably located adjacent serving area 146, allowing the end customer to fit beverage container 104 with a lid stopper immediately prior to travel, as shown.

Figure 19A:
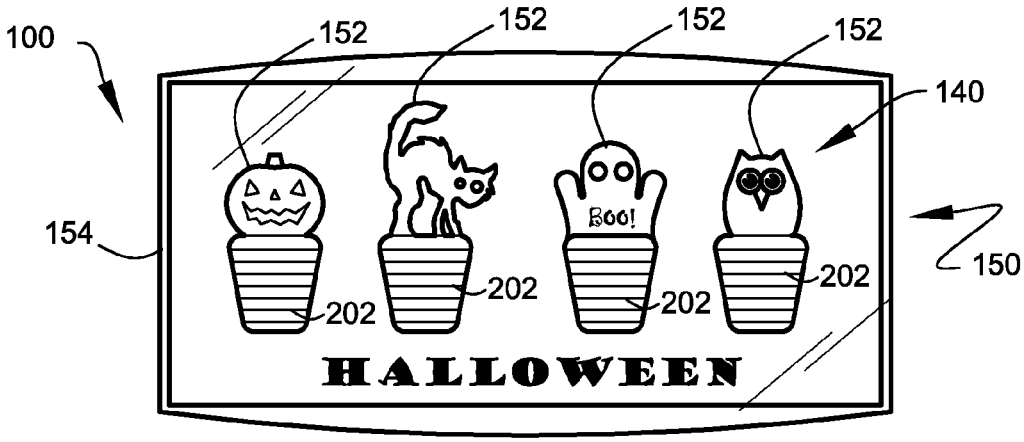
FIG. 19A shows a front elevational view depiction of a thematic grouping of alternate lid stoppers, according to a preferred embodiment of the present invention.

FIG. 19A shows a front elevational view of thematic embodiment 150 comprising a plurality of alternate lid stoppers 202, according to a preferred embodiment of the present invention. Preferably, each alternate lid stopper 202 comprises thematic indicia 152, as shown. In the example of FIG. 19A, thematic indicia 152 comprise seasonal indicia 140, as shown.

To produce thematic embodiment 150 a themed motif is selected for application to the grouping of alternate lid stoppers 202. The selected motif preferably comprises popular themes, such as a holidays, sports themes, graphics representative of a movement or cause, etc. Preferably, thematic embodiment 150 comprises at least two alternate lid stoppers 202, as shown. Preferably, one unique compatible themed image is selected for application to each the alternate lid stoppers 202, as shown. Preferably, two or more of the stoppers are dissimilar in design, as shown. Preferably, the lid stoppers are then grouped within a single package 154, as shown.

Figure 19B:
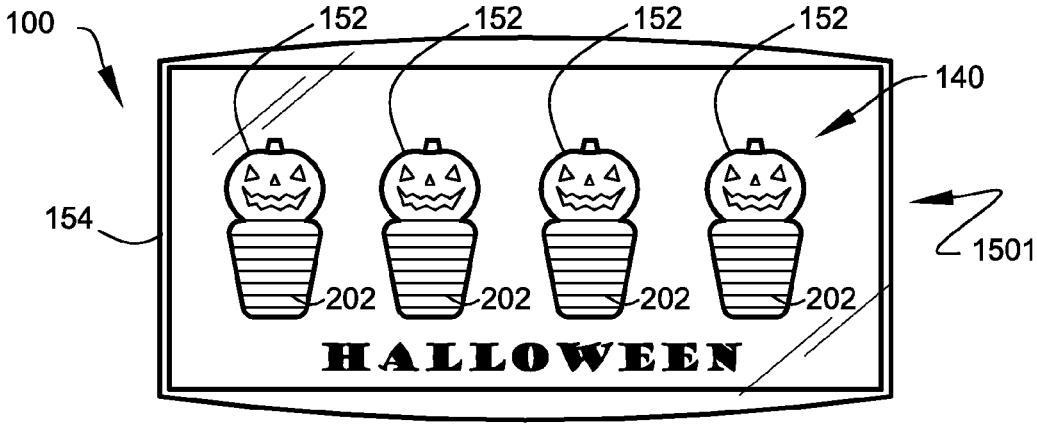
FIG. 19B shows a front elevational view depiction of a thematic grouping of alternate lid stoppers, according to another preferred embodiment of the present invention.

FIG. 19B shows a front elevational view of thematic embodiment 151 comprising a plurality of alternate lid stoppers 202, according to another preferred embodiment of the present invention. Preferably, each alternate lid stopper 202 comprises thematic indicia 152, as shown. In the example of FIG. 19B, thematic indicia 152 comprise seasonal indicia 140, as shown.

To produce thematic embodiment 151 a single themed motif is selected for application to the grouping of alternate lid stoppers 202. Preferably, thematic embodiment 151 comprises at least two alternate lid stoppers 202 each comprising a substantially identical themed image, as shown. Preferably, the lid stoppers are then grouped within a single package 154, as shown.

Figure 20:
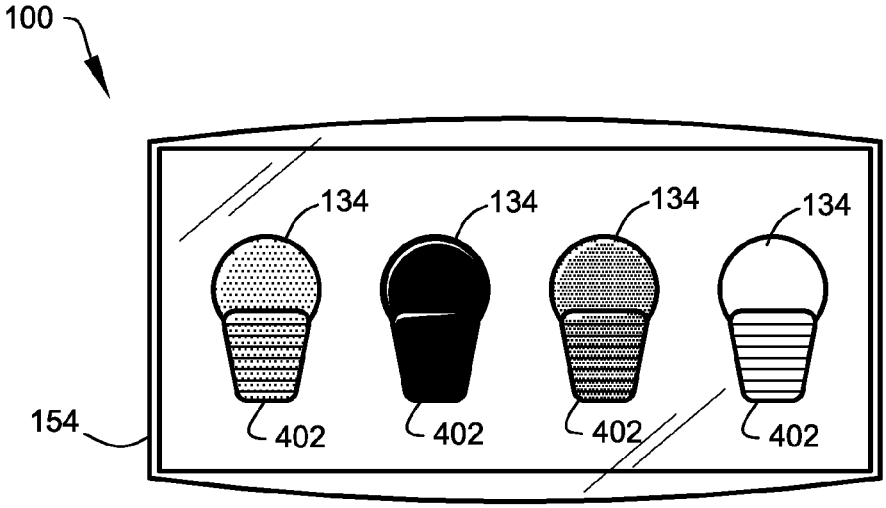
FIG. 20 shows a front elevational view depiction of a grouping of alternate lid stoppers, each comprising a unique identifying feature, according to a preferred embodiment of the present invention.

FIG. 20 shows a front elevational view of a grouping of differentiated lid stoppers 402, each comprising a unique identifying feature, according to a preferred embodiment of the present invention. In the example of FIG. 20, the unique identifying feature comprises color indicia 134, as shown. Preferably, each differentiated lid stopper 402 is grouped within one package 154, as shown.

Preferably, differentiated lid stoppers 402 enable a preferred method of beverage container stopper system 100 related to distinguishing one specific beverage container 104 within a group of similar beverage containers 104. The inherent uniformity of beverage container 104 often makes distinguishing one container from another very difficult. In a group environment, this often leads to confusion as to which beverage container belongs to which individual. Providing a plurality of differentiated lid stoppers 402 allows a user to select a specific stopper to identify his or her cup. This preferred feature has a distinct advantage of reducing confusion within the group of beverage drinkers. The unique identifying features of differentiated lid stoppers 402 preferably comprise such features as color, shape, material, texture, qualities of transparency, reflective properties, internal illumination, size, use of thematic motifs, etc.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system related to stoppering at least one non-circular sipping aperture located within at least one disposable lid of at least one beverage cup comprising:

a) at least one stopper body structured and arranged to stopper the at least one non-circular sipping aperture;

b) wherein said at least one stopper body comprises i) at least one top portion, ii) at least one bottom portion, and iii) at least one longitudinal axis extending through said at least one top portion and said at least one bottom portion;

c) wherein at least one portion of said at least one stopper body comprises at least two feature sets comprising cross sections, each cross section defined by a rectangular portion, with at least one set of opposing sides of said rectangular portions of said cross sections capped with rounded ends, each said cross section being oriented substantially perpendicular to said at least one longitudinal axis;

d) wherein each feature set of said at least two feature sets of said cross-sections cross sections comprises i) a first said cross section comprising a first perimeter, ii) a second said cross section comprising a second perimeter, iii) a third said cross section comprising a third perimeter, iv) a fourth said cross section comprising a fourth perimeter;

v) wherein said second perimeter is lower in perimeter value than both said first perimeter and said third perimeter, vi) wherein said third perimeter is lower in perimeter value than said first perimeter, vii) wherein said fourth perimeter is lower in perimeter value than said second perimeter and said third perimeter, viii) wherein said first said cross section is positioned above said second said cross section, ix) wherein said second said cross section is positioned above said third said cross section, and x) wherein said third said cross section is positioned above said fourth said cross section;

xi) wherein each feature set of said at least two feature sets further comprises a continuous concave curve joining said first said cross section and said third said cross section.

2. The system according to claim 1 wherein said at least one top portion comprises at least one grip adapted to assist user gripping of said at least one stopper body.

3. The system according to claim 2 wherein said at least one grip comprises graphic indicia.

4. The system according to claim 2 wherein said at least one grip comprises at least one shape of at least one recognizable symbol.

5. The system according to claim 1 wherein said continuous concave curve has depth about equal to its width.

6. The system according to claim 2 wherein said at least one grip comprises indicia.

7. The system according to claim 1 wherein said at least one stopper body further comprises at least one first set of opposing sides and at least one second set of opposing sides.

8. The system according to claim 7 wherein:

a) said at least one first set of opposing sides comprises at least one front wall and at least one rear wall; and b) said at least one second set of opposing sides comprise at least one first curving sidewall and at least one second curving sidewall.

9. The system according to claim 8 wherein said at least one stopper body comprises an overall height measured between said at least one top portion and said at least one bottom portion of about one-half of one inch.

10. The system according to claim 1 further comprising at least one container comprising at least one hollow interior compartment adapted to removably contain a plurality of said at least one stopper body.

11. The system according to claim 10 wherein said at least one container comprises at least one transparent portion adapted to provide at least one view of said at least one hollow interior compartment from outside said at least one container, even when said at least one container is in a closed position.

12. The system according to claim 10 wherein said at least one container comprises at least one aperture adapted to assist in the hanging display of said plurality of said at least one stopper bodies.

13. The system according to claim 10 further comprising at least one retail display fixture adapted to assist retail display of said plurality of said at least one stopper body.

14. The system according to claim 1 wherein said at least one stopper body is constructed from at least one material substantially matching that of the at least one disposable lid.

15. The system according to claim 10 wherein said at least one container comprises at least one plurality of stopper bodies, and wherein each stopper body of said at least one plurality of stopper bodies comprises distinguishing indicia uniquely distinguishing each stopper body from each other stopper body.

16. The system according to claim 1 wherein said at least one stopper body comprises at least one stopper motif and at least one themed image compatible with said at least one stopper motif.

17. The system according to claim 1 wherein said at least one stopper body comprises graphic indicia.

18. The system according to claim 2 wherein said at least one grip comprises graphic indicia.

19. The system according to claim 2 wherein said at least one grip is in the shape of at least one recognizable symbol.

20. The system according to claim 2 wherein said at least one grip is in the shape of at least one recognizable symbol.

* * * * *